United States Patent [19]

Holt

[11] 4,373,372

[45] Feb. 15, 1983

[54] APPARATUS FOR ASSEMBLING ELECTRICAL CABLES TO ELECTRICAL CONNECTORS

[75] Inventor: Harley R. Holt, Forest Park, Ill.

[73] Assignee: Bunker Ramo Corporation, Oak Brook, Ill.

[21] Appl. No.: 167,945

[22] Filed: Jul. 14, 1980

[51] Int. Cl.[3] ..... B21K 25/00

[52] U.S. Cl. ..... 72/406; 72/410; 72/416; 72/470

[58] Field of Search ..... 72/189, 197, 198, 211, 72/212, 360, 406, 407, 409, 410, 412, 416, 470; 29/751, 753; 140/105, 113

[56] References Cited

U.S. PATENT DOCUMENTS

| | | | |
|---|---|---|---|
| 2,248,147 | 7/1941 | Wilson | 72/189 |
| 2,639,754 | 5/1953 | Macy | 81/348 |
| 2,903,929 | 9/1959 | McVey | 72/416 |

FOREIGN PATENT DOCUMENTS

| | | | |
|---|---|---|---|
| 370961 | 4/1932 | United Kingdom | 140/113 |

*Primary Examiner*—Lowell A. Larson

[57] ABSTRACT

A hand tool for assembling electrical cables to an electrical connector which has a cable clamp for clamping a cable in position for termination with conductive contact means on the connector. The tool includes a pair of roller members mounted on a base for rotation about generally parallel, spaced axes of rotation. The roller members have opposed notches in the peripheries thereof, defining jaws for movement toward and away from the connector to engage the cable clamp for crimping a cable to provide strain relief therefor. A hand lever is fixed at one end thereof to one roller member and extends outwardly therefrom in a plane generally perpendicular to the axes of rotation of the roller members. A link directly interconnects the roller members for conjoint rotation thereof in opposite directions toward and away from the cable clamp means in response to movement of the hand lever.

17 Claims, 4 Drawing Figures

APPARATUS FOR ASSEMBLING ELECTRICAL CABLES TO ELECTRICAL CONNECTORS

BACKGROUND OF THE INVENTION

This invention is directed to a hand operated tool for assembling electrical cables to an electrical connector. More particularly, the exemplary embodiment of the invention is directed to an apparatus for crimping a cable clamp means, hereinafter sometimes referred to as clamp, onto a cable in position for termination with conductive contact means, sometimes referred to herein as contacts, on the connector, the cable clamp means being associated with the connector itself.

In the electrical industry, particularly in such fields as telecommunications or the like, a continuing problem is to provide tools or apparatus for simply performing various operations on electrical wires or cables, such as connecting, terminating or crimping the wires or cables to electrical connectors or terminals, and for otherwise handling the wires in a simple and efficient manner during volume manufacturing. This is particularly true for multi-conductor cables which have numerous individual wires for termination to plural contacts of an electrical connector. For instance, with such connectors as the well-known Amphenol Series 57 and 157 electrical connectors, an elongated connector body is provided with receptacle means including a plurality of linearly oriented slots or notches which are adapted for receiving individual contacts. The contacts may be capable of being soldered, or connected by insulation displacement techniques to the individual wires of an electrical cable. Considerable manipulation of the numerous individual wires is required, and means often and provided on the assembly tool itself for clamping or holding the cable while the individual wires are terminated to the connector contacts.

However, certain connectors of the character described now are being provided with an integral clamp which is utilized to clamp onto the outer covering of the cable and provide a strain relief thereof. In my co-pending application, Ser. No. 06/130,295, filed Mar. 14, 1980, a cable clamp closing apparatus for such connectors is disclosed in the form of an attachment for an automatic terminating machine. Pliers-type hand tools have been used for closing connector cable clamps in the field, but such tools are difficult to manipulate while at the same time manipulating the cable and clamp, and such tools simply do not have a sufficiently large target area for receiving a spread clamp prior to crimping. There is a need for a simple and versatile, self-contained hand tool for crimping cable clamps, where the tool comprises a separate apparatus for use in the field, as a bench tool, or for like applications.

SUMMARY OF THE INVENTION

Accordingly, an object of the present invention is to provide an apparatus in the form of a hand tool for assembling electrical cables to electrical connectors, including means for crimping a cable clamp portion of the connector onto a cable to provide strain relief therefor.

More particularly, in the exemplary embodiment of the invention, a base is provided with a pair of opposed jaw members rotatably mounted on the base for movement about generally parallel, spaced axes of rotation toward and away from a connector to engage the cable clamp means thereof for clamping a cable to provide strain relief therefor. An actuator member is mounted on one of the jaw members for rotating the jaw member, and direct-drive link means interconnects both jaw members for conjoint rotation thereof in opposite directions toward and away from the cable clamp means in response to movement of the actuator member.

The jaws are formed by opposed notches in the peripheries of a pair of roller members, and the actuator member comprises a hand lever fixed at one end thereof to one of the roller members so as to extend outwardly therefrom in a plane generally perpendicular to the axes of rotation of the roller members. Spring means interconnects the roller members for biasing the members in an opening direction away from the cable clamp means. Stop means is provided between the base and one of the roller members for limiting movement of the roller members in a closing direction to preclude excessive crimping forces on the cable clamp means.

In one form of the invention, the link means comprises a rigid, slidable plate extending directly between the roller members in driving relationship therewith. The rigid plate is disposed within opposed, facing grooves in the peripheries of the roller members. Back-up spring means is disposed in one of the grooves for biasing the slidable plate into the other of the grooves.

In another form of the invention, the link means comprises a flexible leaf spring extending between the roller members in a direct driving relationship therewith, and slidably received within the opposed, facing grooves in the peripheries of the roller members.

The invention, therefore, provides a versatile, self-contained hand tool for crimping cable clamps, in the form of a separate apparatus for use in the field, as a bench tool, or for like applications.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
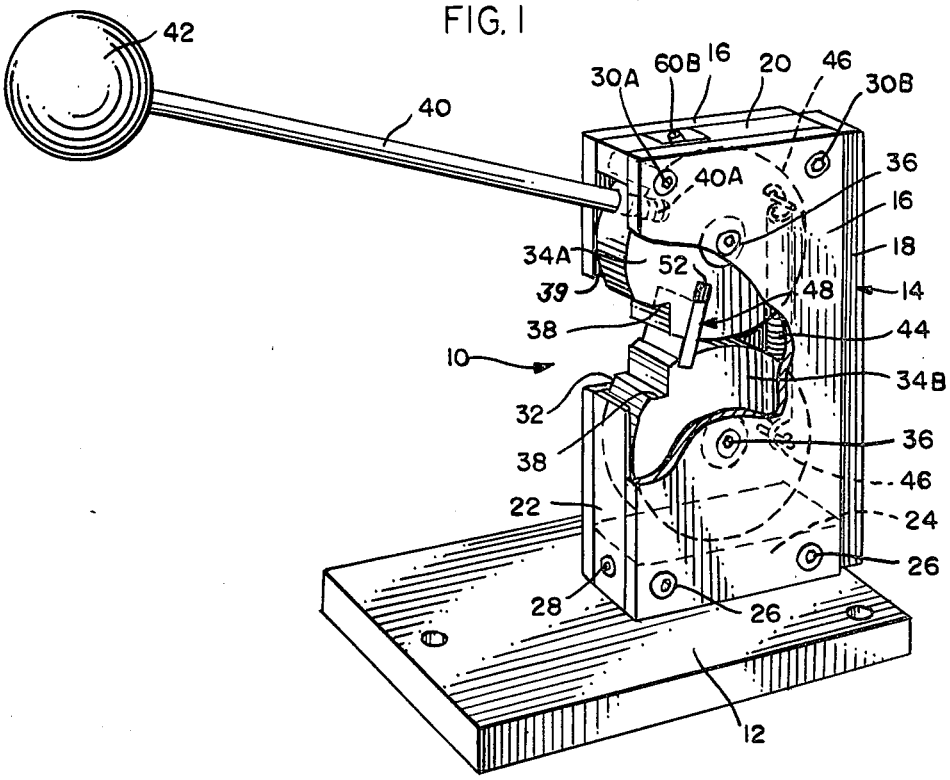
FIG. 1 is a perspective view of an apparatus for assembling electrical cables, or the like, to an electrical connector, embodying the concepts of the present invention, with a portion of the housing broken away to facilitate the illustration of certain interior components thereof.

Referring to the drawings in greater detail, and first to FIG. 1, an apparatus, generally designated 10, is designed for assembling electrical cables, or the like, to an electrical connector which has a cable clamp means for clamping a cable in position with the individual wires thereof terminated with conductive contact means on the connector. The connector, cable clamp means and cable will be described in greater detail hereinafter in relation to FIG. 2.

Apparatus 10 has a base which includes a lower portion 12 and an upstanding housing portion, generally designated 14. The upstanding housing includes a pair of side walls 16, a rear wall 18, a top wall 20, and a front wall 22. These walls define a generally hollow structure, and the side, front and rear walls seat over a mounting block 24 which is secured to or integral with lower support portion 12 of the base. Side walls 16 are secured to mounting block 24 by a pair of bolts 26. Similar bolts (not shown) extend through rear wall 18 at the lower end thereof to secure the rear wall to mounting block 24. The same is true for front wall 22, by means of a bolt 28. Front wall 22 and top wall 20 actually may comprise integral portions of either of the side walls. Front and rear bolts 30A and 30B, respectively, secure the top of the housing portion and extend through side walls 16.

It can be seen that front wall 22 extends upwardly only approximately one-half of the height of housing portion 14, so as to define a front opening, generally designated 32, in the front of the housing.

A pair of upper and lower roller members 34A and 34B, respectively, are mounted within housing portion 14 of the base for rotation about generally parallel, spaced horizontal axes which are defined by shafts 36. Shafts 36 are journalled in side walls 16. The rollers have opposed notches 38 cut into the peripheries thereof, defining jaws for movement toward and away from a connector to engage cable clamp means on the connector for clamping a cable to provide strain relief therefore. The side walls of housing 14 are cut-out, as at 39, to provide access to the mouth area defined between jaws 38 for accepting a connector and cable clamp. It can be seen that with the use of rollers with notches cut in the peripheries thereof, a wide target area is provided for accepting a spread cable clamp prior to crimping.

An actuator in the form of a lever member 40 is fixed at one end 40A to upper roller 30A so as to extend outwardly therefrom through opening 32 in housing portion 14, in a plane generally perpendicular to the axes of rotation of the rollers defined by shafts 36. A knob-like handle 42 is secured to the outer end of lever member 40 to facilitate manual manipulation thereof and effect rotation of roller members 34A, 34B.

A coil spring 44 is wrapped about a pair of pins 46 secured to the rollers. The spring is maintained in tension and, being interconnected between the rollers, biases the rollers in an opening direction away from the cable clamp.

Direct-drive link means, generally designated 48 in FIG. 1, interconnects rollers 34A, 34B for conjoint rotation thereof in opposite directions toward and away from a cable clamp in response to movement of lever member 40.

Figure 2:
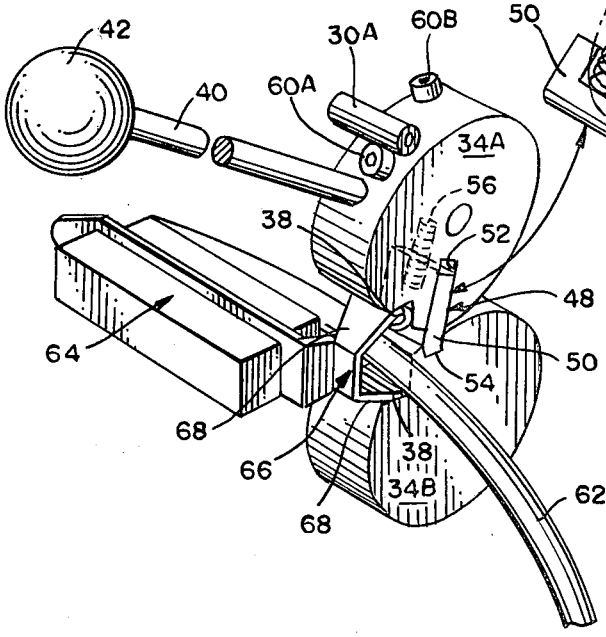
FIG. 2 is a perspective view, on an enlarged scale, of the operative cable clamp closing components of the present invention.
Figure 2A:
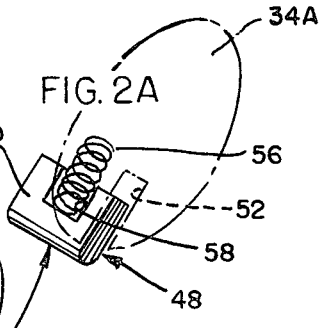
FIG. 2A is a somewhat schematic perspective view illustrating the link means of FIG. 2 which drivingly interconnects the roller members.

Referring to FIGS. 2 and 2A, link means 48 comprises a slidable plate 50 which extends between the rollers in direct driving relationship therewith. Roller 34A has a groove 52 and roller 34B has an opposed, facing groove 54 for slidably receiving plate 50. Groove 52 in roller 34A is deeper than groove 34 in roller 34B, and a back-up coil spring 56 is seated within a recess 58 cut into the rear of plate 50 within groove 52. Spring 56 biases plate 50 toward and into groove 54 in roller 34. In this manner, plate 50 is free to move longitudinally within groove 52 in roller 34A, while maintaining constant engagement with roller 34B within groove 54 thereof, while the rollers are rotated in unison by lever member 40.

Stop means is provided in the form of a pair of front and rear pins 60A and 60B, respectively, protruding outwardly from the top periphery of roller 34A. The pins are positioned so as to abut against bolt 30A which extends between side walls 16 of housing portion 14, and thereby provide limits of movement of the rollers in either direction of rotation.

As seen in FIG. 2, and as stated above, apparatus 10 is designed for assembling electrical cables 62 to an electrical connector, generally designated 64, which has cable clamp means, generally designated 66, for clamping cable 62 in position for termination with conductive contact means (not shown) on the connector. In particular, the cable normally has an outer covering surrounding a plurality of individual wires or conductors (not shown) which are terminated to the individual contacts which normally are positioned within slots of the connector. Cable clamp 66 forms a part of connector 64 and has a pair of outwardly diverging wings 68 which are utilized to clamp onto the outer covering of cable 62 and provide strain relief therefor. Rollers 34A, 34B are shown in FIG. 2 in their fully opened positions, with stop pin 60A abutting against the front of bolt 30A. In this open condition, cable clamp 66, with cable 62 disposed between spring wings 68, is easily positionable between jaws 38 of the roller members.

Figure 3:
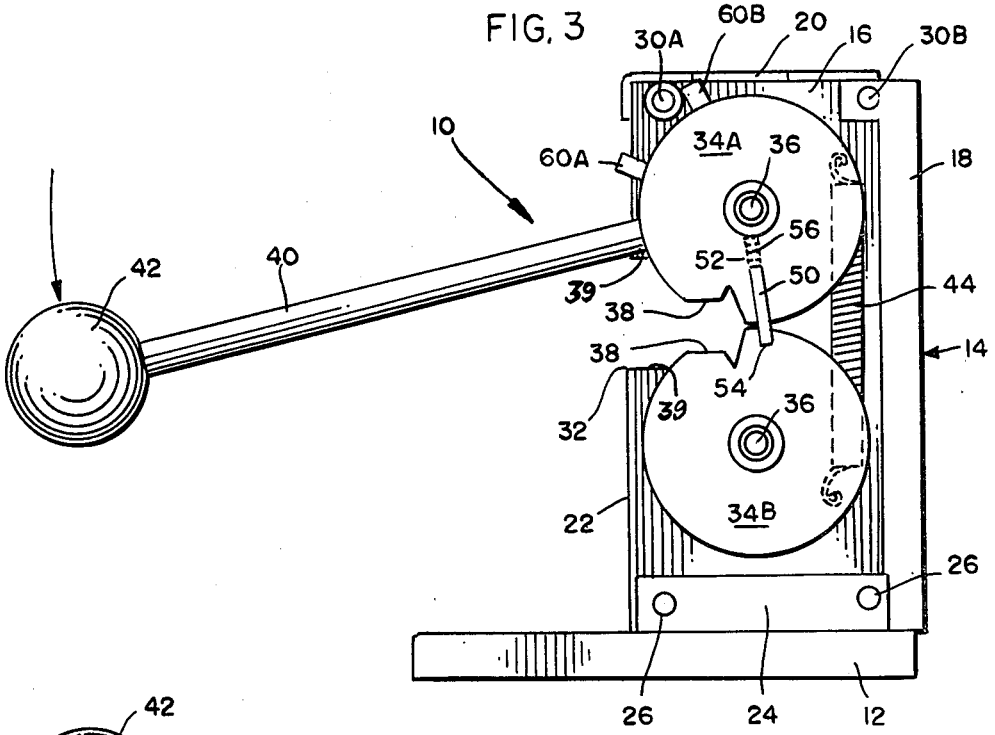
FIG. 3 is a side elevational view of the apparatus of FIG. 1, in a fully closed position, and with the side of the housing removed to facilitate illustration of the interior components.

Referring to FIG. 3, lever member 40 and rollers 30A, 30B are shown in fully closed positions, with stop pin 60B in abuttment against the rear of bolt 30A. Thus, it can be seen that jaws 38 are prevented from closing onto the cable clamp beyond a predetermined angle of rotation of the rollers. This angle is determined so as to prevent excessive clamping forces on cable 62 which might damage the individual electrical wires or conductors therein. On release of lever member 40, spring 44 is effective to return the lever and rollers to their fully opened condition as shown in FIGS. 1 and 2.

Figure 4:
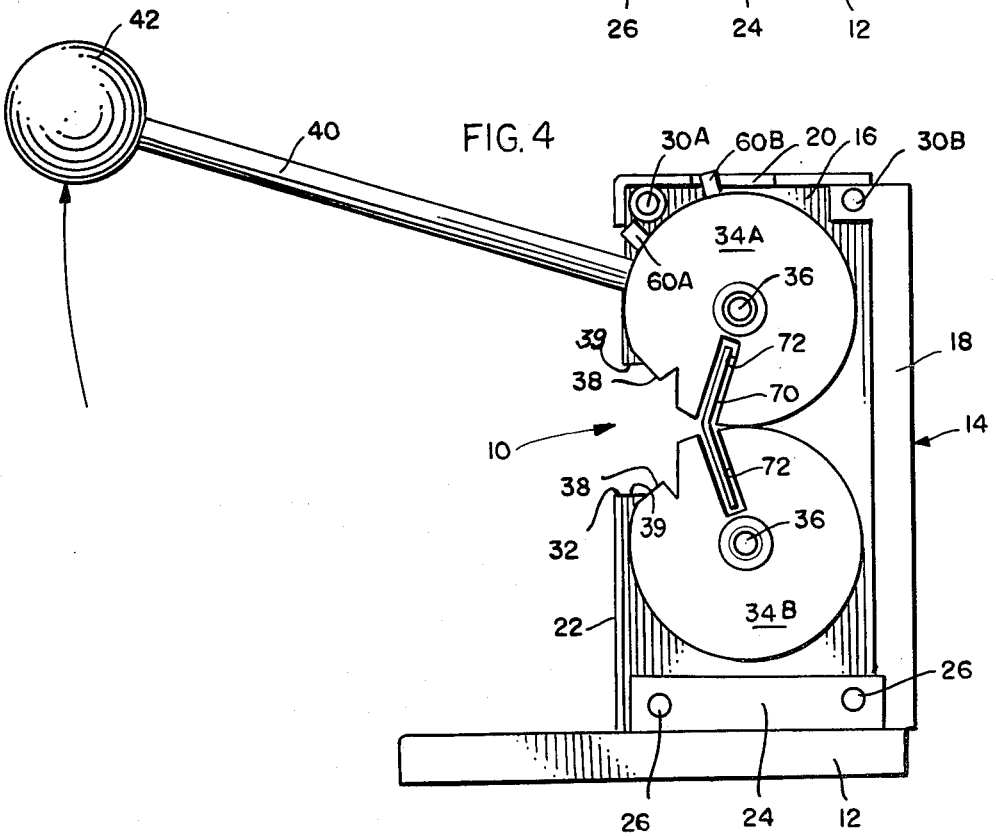
FIG. 4 is a side elevational view similar to FIG. 3, with the apparatus fully opened, and showing an alternate form of link means between the roller members.

Referring to FIG. 4, an alternate form of direct-drive link means is disclosed interconnecting the roller members. More particularly, a flat, flexible leaf spring 70 extends between roller 34A, 34B for drivingly interconnecting the rollers. The leaf spring is slidably received within opposed, facing grooves 72 in the roller members. The grooves are of equal depth, and the leaf spring is self contained therewithin. The rollers and jaws 38 are shown in open condition for receiving cable clamp 66, and like numerals are applied in FIG. 4 for like components of the apparatus corresponding to FIGS. 1-3. With either form of link means, a simple direct drive is provided between the rollers and eliminates such driving mechanisms as gears, belts, or the like.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. Apparatus for assembling electrical cables, or the like, to an electrical connector which has cable clamp means for clamping a cable in position with its conductors terminated to contact means on the connector, comprising:

a base;

a pair of opposed jaw members rotatably mounted on said base for movement about generally parallel, spaced axes of rotation toward and away from a connector to engage said cable clamp means for clamping a cable to provide strain relief therefor;

actuator means for rotating said jaw members; and direct drive link means interconnecting said jaw members for conjoint rotation thereof in opposite directions toward and away from said cable clamp means in response to movement of said actuator means, said direct drive link means comprising a slidable plate extending between said jaw members in driving relationship therewith.

2. The apparatus of claim 1 wherein said jaw members have opposed, facing grooves for slidably receiving said plate.

3. The apparatus of claim 2, including back-up spring means disposed in one of said grooves for biasing said slidable plate into the other of said grooves.

4. Apparatus for assembling electrical cables, or the like, to an electrical connector which has cable clamp means for clamping a cable in position with its conductors terminated to contact means on the connector, comprising:

a base;

a pair of opposed jaw members rotatably mounted on said base for movement about generally parallel, spaced axes of rotation toward and away from a connector to engage said cable clamp means for clamping a cable to provide strain relief therefor;

actuator means for rotating said jaw members; and direct drive link means interconnecting said jaw members for conjoint rotation thereof in opposite directions toward and away from said cable clamp means in response to movement of said actuator means, said drive link means comprising a flexible leaf spring extending between said jaw members in driving relationship therewith.

5. The apparatus of claim 4 wherein said jaw members have opposed, facing grooves for slidably receiving said leaf spring.

6. Apparatus for assembling electrical cables, or the like, to an electrical connector which has cable clamp means for clamping a cable in position with its conductors terminated to contact means on the connector, comprising:

a base;

a pair of roller members mounted on said base for rotation about generally parallel spaced axes, said roller members having opposed notches in the peripheries thereof defining jaws for movement toward and away from a connector to engage said cable clamp means for clamping a cable to provide strain relief therefor;

an actuator member operatively associated with at least one of said roller members; and link means directly interconnecting said roller members for effecting conjoint rotation thereof in opposite directions toward and away from said cable clamp means in response to movement of said actuator member, said link means comprising a slidable plate extending between said roller members and disposed in opposed, facing grooves in the peripheries of the roller members to establish a driving connection therebetween.

7. The apparatus of claim 6 wherein said slidable plate is rigid.

8. The apparatus of claim 7, including back-up spring means disposed in one of said grooves for biasing said slidable plate into the other of said grooves.

9. The apparatus of claim 6 wherein said slidable plate comprises a flexible leaf spring extending between said roller members and disposed in said opposed, facing grooves.

10. The apparatus of claim 6 wherein said actuator member comprises a lever member fixed at one end to one of said roller members and extending outwardly therefrom in a plane generally perpendicular to the axes of rotation of the roller members.

11. The apparatus of claim 6, including spring means interconnecting said roller members for biasing the roller members in an opening direction.

12. The apparatus of claim 6, including stop means between said base and one of said roller members for limiting movement of the roller members in a closing direction.

13. Apparatus for assembling electrical cables, or the like, to an electrical connector which has cable clamp means for clamping a cable in position with its conductors terminated to contact means on the connector, comprising:

a supporting base having an upstanding, generally hollow housing mounted thereon;

a pair of roller members mounted within said housing for rotation about generally parallel spaced axes, said roller members having opposed notches in the peripheries thereof defining jaws for movement toward and away from a connector to engage said cable clamp means for clamping a cable to provide strain relief therefor;

a hand lever fixed at one end to one of said roller members and extending outwardly through an enlarged opening in said housing for movement within said opening in a plane generally perpendicular to the axes of rotation of the roller members;

cut-out means in said housing to provide access therethrough by said cable clamp means to the mouth area between said movable jaws; and direct-drive link means interconnecting said roller members for effecting conjoint rotation thereof in opposite directions toward and away from said cable clamp means in response to movement of said hand lever, said link means comprising a slidable plate extending between said roller members and disposed in opposed, facing grooves in the peripheries of the roller members to establish a driving connection therebetween.

14. The apparatus of claim 13, wherein said slidable plate is rigid, and further including back-up spring means disposed in one of said grooves for biasing said slidable plate into the other of said grooves.

15. The apparatus of claim 13 wherein said slidable plate comprises a flexible leaf spring extending between said roller members and disposed in said opposed, facing grooves.

16. The apparatus of claim 13, including stop means between said base and one of said roller members for limiting movement of the roller members in a closing direction.

17. Apparatus for assembling electrical cable or the like to an electrical connector which has cable clamp means for clamping a cable in position with its conductors terminated to contact means on the connector, the cable clamp means having opposing wing members adapted to be bent one toward the other after engaging a cable therebetween, said apparatus comprising:

a base;

a pair of opposing jaw members rotatably mounted on said base for movement about generally parallel, spaced axes of rotation toward and away from a connector, each of said jaw members having a jaw defining surface portion lying substantially in a plane which is in turn generally parallel to said axes of rotation and extending from the outer periphery of the jaw member toward and substantially perpendicular to a plane passing through both said axes of rotation when said jaw defining surfaces are in a closed clamping position relative to each other and the extremities of the clamp means wings when said wings are placed between said jaw defining surfaces;

manually operable actuator means for rotating said jaw members;

direct drive link means interconnecting said jaw members for conjoint rotation thereof in opposite directions toward and away from said cable clamp means when the wings thereof are placed between said rotated jaw defining surfaces in response to movement of said actuator means;

stop means between said base and one of said jaw members for limiting movement of the jaws in a closing direction to prevent overstressing of the cable clamp wing members;

and spring means coupled to said jaw members for holding the same in spring biased open relationship relative to one another when said actuator means is manually released.

* * * * *